United States Patent [19]

Ishikawa et al.

[11] Patent Number: 4,548,181

[45] Date of Patent: Oct. 22, 1985

[54] METHOD OF CONTROLLING THE FUEL SUPPLY TO AN INTERNAL COMBUSTION ENGINE AT ACCELERATION

[75] Inventors: Yoshikazu Ishikawa, Hiki; Takeo Kiuchi, Asaka, both of Japan

[73] Assignee: Honda Giken Kogyo K.K., Tokyo, Japan

[21] Appl. No.: 620,387

[22] Filed: Jun. 13, 1984

[30] Foreign Application Priority Data

Jun. 22, 1983 [JP] Japan ..... 58-112297

[51] Int. Cl.[4] ..... F02M 51/00; F02B 3/00

[52] U.S. Cl. ..... 123/492; 123/493

[58] Field of Search ..... 123/492, 493, 463, 462, 123/445, 478; 364/431.05

[56] References Cited

U.S. PATENT DOCUMENTS

| | | | |
|---|---|---|---|
| 4,126,107 | 11/1978 | Harada et al. | 123/492 |
| 4,221,191 | 9/1980 | Asano et al. | 123/492 |
| 4,326,488 | 4/1982 | Herth et al. | 123/492 |
| 4,359,993 | 11/1982 | Carlson | 123/492 |
| 4,363,307 | 12/1982 | Amano et al. | 123/492 |
| 4,413,602 | 11/1983 | Inoue et al. | 123/492 |
| 4,434,768 | 3/1984 | Ninomiya | 123/492 |
| 4,450,816 | 5/1984 | Takimoto et al. | 123/492 |
| 4,457,283 | 7/1984 | Kobayashi et al. | 123/492 |

*Primary Examiner*—Raymond A. Nelli

*Attorney, Agent, or Firm*—Arthur L. Lessler

[57] ABSTRACT

A control method of supplying an internal combustion engine with required quantities of fuel appropriate to operating conditions of the engine, in synchronism with pulses of a control signal generated at predetermined crank angle positions of the engine. When the engine is operating in a predetermined accelerating condition, a correction variable for increasing the fuel supply quantity for supply to the engine at acceleration is determined as a function of the number of pulses of the above control signal generated after the predetermined accelerating condition has been detected for the first time, as well as of the rate of change of the value of a predetermined operating parameter indicative of the engine load which is detected in synchronism with a predetermined sampling signal, to thereby set a quantity of fuel for supply to the engine at acceleration. Preferably, values of the correction variable are read from a plurality of tables in which are set different predetermined values as functions of the rate of change of the value of the predetermined operating parameter, preferably the rate of change of throttle valve opening, and which are selected in response to the number of pulses of the above control signal successively generated from the time of the first detection of the predetermined accelerating condition of the engine.

10 Claims, 9 Drawing Figures

| FIG. 5A | FIG. 5B |
|---|---|

METHOD OF CONTROLLING THE FUEL SUPPLY TO AN INTERNAL COMBUSTION ENGINE AT ACCELERATION

BACKGROUND OF THE INVENTION

This invention relates to a method of controlling the fuel supply to an internal combustion engine at acceleration, and more particularly to a method of this kind which is intended to improve the accelerability of the engine without spoiling the driveability at the beginning of acceleration of the engine.

A fuel supply control method for internal combustion engines is already known which is adapted to first determine a basic value of the valve opening period of a fuel injection device provided in the engine, i.e. the fuel injection quantity, as a function of engine rotational speed and intake pipe absolute pressure in synchronism with generation of pulses of a predetermined crank angle position signal, e.g. a top-dead-center (TDC) signal, and then correct the basic value thus determined by adding to and/or multiplying same by constants and/or coefficients being functions of parameters indicative of operating conditions of the engine such as engine rotational speed, intake pipe absolute pressure, engine coolant temperature, throttle valve opening, exhaust gas ingredient concentration (oxygen concentration), etc., to thereby control the air/fuel ratio of a mixture being supplied to the engine.

It is a general tendency with internal combustion engines that even when the fuel supply quantity is increased and accordingly the mixture is enriched in order to accelerate the engine, the rotational speed of the engine does not increase immediately upon the increase of the fuel supply quantity due to a time lag between the start of supply of such increased fuel quantity to the engine and actual increase of the engine output torque and accordingly actual increase of engine rotational speed. Such time lag is attributable not only to a time lag between the start of supply of the increased fuel quantity and explosive combustion of the mixture within the engine cylinders, but also to a detection lag of sensors for sensing the operating conditions of the engine, a time lag between opening action of the throttle valve and actual increase of the charging efficiency of the engine and according actual increase of the intake air quantity, etc. Particularly, in an internal combustion engine equipped with an electronically controlled fuel injection device, a large volume space is usually provided in the intake passage at a location downstream of the throttle valve for restraining fluctuations in the intake passage pressure to thereby minimize fluctuations in the intake air quantity. As compared with internal combustion engines equipped with carburetors, the above time lag between the supply of an accelerating increased fuel quantity to the engine and actual increase of the engine speed is conspicuous in such electronically controlled engine due to a longer period of time between opening action of the throttle valve and actual increase of the charging efficiency of the engine.

In order to compensate for a detection lag of the actual intake air quantity supplied to the engine at acceleration, it has conventionally been employed, for instance, to detect the opening speed of the throttle valve, set a value of a correction variable for increase of the fuel quantity on the basis of the detected opening speed, and supply a quantity of fuel increased by the set value of the correction variable. However, according to such accelerating fuel quantity control method, at the beginning of acceleration of the engine, that is, during a period of time after initial detection of acceleration of the engine and before several pulses of the aforementioned TDC signal are generated, the engine cannot have an increase in the output torque to a level required for the acceleration since there does not occur a sufficient increase in the charging efficiency before the lapse of the above period of time for the aforementioned reason. However, immediately when the charging efficiency and accordingly the actual intake air quantity has increased to such required level, the engine can undergo a sudden increase in the output torque. This sudden increase in the output torque causes rotational displacement of the engine body about its crankshaft. That is, while the engine body is generally mounted on a mount provided in a vehicle body, etc. via an elastic shock absorber formed e.g. of rubber, the torque increase causes an impact upon the engine mount to an extent beyond the limit of absorption of impact or shock by the shock absorber. This gives an unpleasant feeling of shock to the driver, etc.

Further, when the engine is accelerated from a decelerating state wherein the position of the engine body on the mount is usually biased toward the decelerating side with respect to its neutral position, the resulting amount of displacement of the engine body is large as compared with that obtained when the engine is accelerated from a cruising state, resulting in a large shock being given to the driver, etc. In addition, the presence of backlash of parts of the driving system of the vehicle such as the transmission gear forms a further factor for increasing the accelerating shock.

SUMMARY OF THE INVENTION

It is the object of the invention to provide a fuel supply control method for internal combustion engines, which is capable of reducing the time lag between detection of a predetermined accelerating condition of the engine and occurrence of an increase in the output torque to a level effective for acceleration of the engine to thereby enhance the accelerability of the engine, and also capable of mitigating a shock upon acceleration of the engine.

The present invention provides a control method of supplying an internal combustion engine with required quantities of fuel appropriate to operating conditions of the engine, in synchronism with pulses of a control signal generated at predetermined crank angle positions of the engine.

The method according to the invention is characterized by the following steps: (1) determining whether or not the engine is operating in a predetermined accelerating condition; (2) detecting a value of a predetermined operating parameter of the engine indicative of the engine load, in synchronism with a predetermined sampling signal is generated; (3) determining a rate of change in the value of the predetermined operating parameter from values of the same detected in the step (2); (4) when it is determined in the step (1) that the engine is operating in the predetermined accelerating condition, determining a value of a correction variable for increasing the fuel quantity to be supplied to the engine at acceleration, which corresponds to the number of pulses of the above control signal generated from the time the determination that the engine is operating in the predetermined accelerating condition is obtained for the first time, and also corresponds to the rate of change in the value of the predetermined operating parameter detected in the step (3); (5) applying the determined value of the correction variable to setting of a quantity of fuel to be supplied to the engine in the predetermined accelerating condition; and (6) supplying the set quantity of fuel to the engine in the predetermined accelerating condition.

Preferably, a plurality of tables are stored beforehand, each of which is formed of a plurality of values of the correction variable corresponding, respectively, to different values of the rate of change of the value of the predetermined operating parameter, and wherein the above step (4) comprises selecting a different one of the above tables which corresponds to the number of pulses of the above control signal generated from the time the determination that the engine is operating in the predetermined accelerating condition is obtained for the first time, and reading from the selected table a value of the correction variable which corresponds to a value of the rate of change of the value of the predetermined operating parameter detected in the step (3).

Also preferably, the above plurality of tables are divided into a plurality of groups which are to be selected in response to at least one second operating parameter of the engine other than the first-mentioned predetermined operating parameter, and wherein the above step (4) comprises detecting a value of the at least one second operating parameter when the determination that the engine is operating in the predetermined accelerating condition is obtained for the first time, selecting one of the above plurality of groups of tables which corresponds to the detected value of the at least one second operating parameter, and reading a value of the correction variable from the selected one group of tables, which corresponds to the number of pulses of the control signal generated from the time the determination that the engine is operating in the predetermined accelerating condition is obtained for the first time, and also corresponds to a value of the rate of change of the value of the predetermined operating parameter detected in said step (3).

Preferably, the above engine is provided with an intake passage and a throttle valve arranged in the intake passage, and the first-mentioned predetermined operating parameter is the valve opening of the throttle valve.

Also preferably, the setting of a fuel quantity of the step (5) based upon the correction variable is effected only when the rate of change of the throttle valve opening detected in the step (3) is larger then a predetermined value.

The above at least one second operating parameter of the engine includes the rotational speed of the engine, and a parameter indicative of whether or not a first pulse of the control signal has been generated after interruption of the fuel supply to the engine which is effected while the engine is decelerating in a predetermined condition.

Preferably, values of the correction variable which form each of tables of one of the groups to be selected when a detected value of the rotational speed of the engine is lower than a predetermined value are set such that they assume smaller values with an increase in the number of pulses of the control signal generated from the time the determination that the engine is operating in the predetermined accelerating condition is obtained for the first time, so long as the value of the rate of change in the value of the first-mentioned predetermined operating parameter remains constant.

The above and other objects, features and advantages of the invention will be more apparent from the ensuing detailed description taken in conjunction with the accompanying drawings.

DETAILED DESCRIPTION

Figure 1:
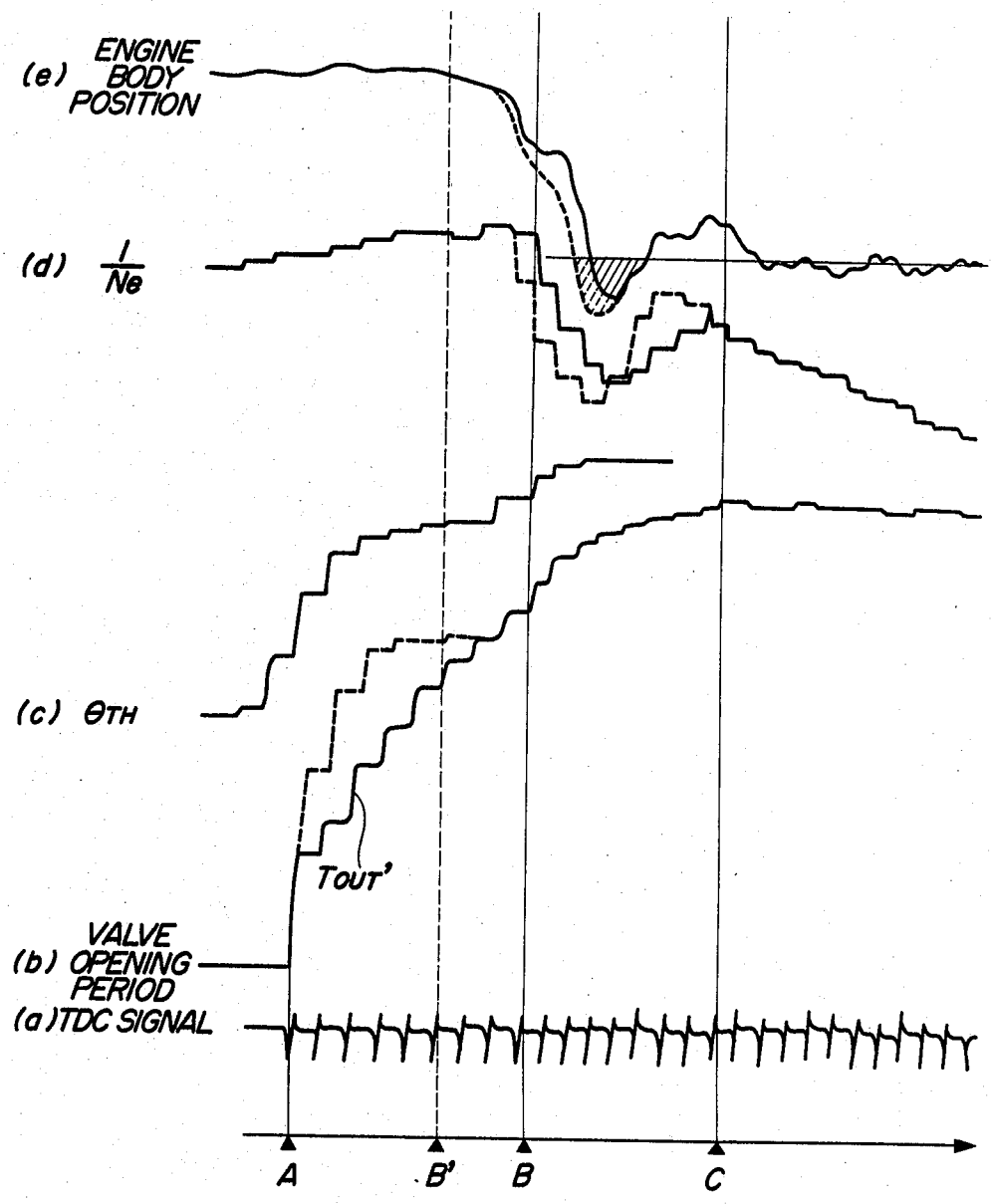
FIG. 1 (PRIOR ART)
FIG. 1 is a timing chart showing changes in the engine rotational speed Ne and displacement of the engine body on its mount with the lapse of time at acceleration of the engine according to a conventional fuel supply control method.
Figure 2:
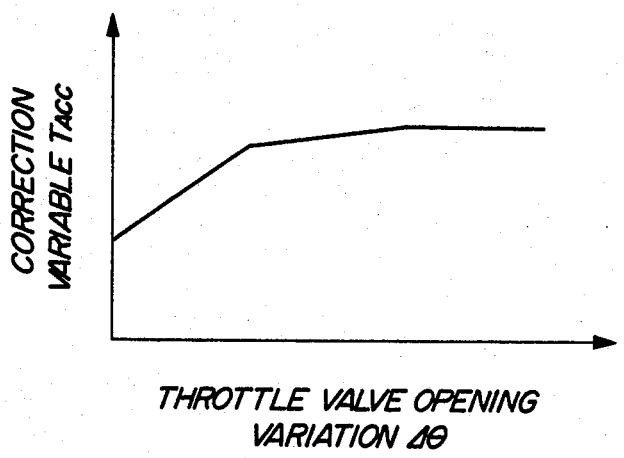
FIG.2 (PRIOR ART)
FIG. 2 is a graph showing the relationship between the correction variable TACC and the rate of change of the throttle valve opening $\Delta\theta$ according to a conventional fuel supply control method.

Referring first to FIGS. 1 and 2, there are shown operating characteristics, etc. of an internal combustion engine obtained if a conventional fuel supply control method is applied at acceleration of the engine. When an accelerating condition of the engine is detected, a correction variable TACC, which is applied for increasing the fuel supply quantity at acceleration of the engine, is set to a value corresponding to the opening speed or rate of change $\Delta\theta$ of the valve opening of the throttle valve, and the value of correction variable TACC thus set is added to a valve opening period value TOUT' which is set as a function of engine operating parameters such as intake pipe absolute pressure and engine rotational speed Ne, to thereby enrich a mixture supplied to the engine at acceleration of the engine. The solid line in (b) of FIG. 1 represents changes in the valve opening period value TOUT' set as above, while the broken line in (b) of FIG. 1 represents the sum of the same value TOUT' and a set value of the correction variable TACC.

According to this fuel supply control method, if at acceleration the engine is supplied with fuel in accordance with changes in the valve opening period value TOUT' with no addition of the correction variable TACC as indicated by the solid line in (b) of FIG. 1, then the position of the engine body and the rotational speed Ne of the engine change as indicated by the respective solid lines in (e) and (d) of FIG. 1. To be specific, the valve opening period value TOUT' is set to values corresponding to increases in the intake pipe absolute pressure caused by opening the throttle valve ((c) in FIG. 1). There is a time lag between the time the valve opening period value TOUT' starts to be increased upon acceleration of the engine, i.e. at the point A on the abscissa of time in FIG. 1 and the time the engine rotational speed Ne actually starts increasing or the reciprocal 1/Ne of same starts decreasing ((d) in FIG. 1), i.e. at the point B on the abscissa of time, with an increase in the engine output torque caused by the increase in the fuel supply quantity resulting from the increase of the valve opening period TOUT'. This time lag corresponds to the time period required for eight pulses of the TDC signal to be generated in the illustrated example ((a) in FIG. 1), and is mainly caused by not only the time lag between the supply of fuel to the engine and the occurrence of explosive combustion of the fuel within the engine cylinders, but also by detection lag of sensors for sensing operating conditions of the engine, as well as by the time lag between the opening action of the throttle valve and actual increase of the charging efficiency of the engine cylinders to such a level that the actual intake air quantity can assume a value required for causing an increase in the output torque effective for acceleration of the engine. Particularly, in an internal combustion engine equipped with an electronically controlled fuel injection device wherein a large space is generally provided within the intake pipe at a location downstream of the throttle valve to increase the substantial intake passage volume so as to restrain fluctuations in the intake pipe pressure and thereby reduce the resulting flutuations in the intake air quantity, the time lag between the opening action of the throttle valve and the actual increase in the charging efficiency is larger than those of other type internal combustion engines such as carburetor engines. That is, in the electronically controlled engine, the time lag corresponding to the time interval between the points A and B in FIG. 1 is larger than that in carburetor engines.

During the time period A–B in FIG. 1, the actual intake air quantity cannot be detected with accuracy due to detection lag of engine operating parameter sensors, mainly the intake pipe absolute pressure sensor, rendering it impossible to supply just a required amount of fuel to the engine during the same time period A–B and accordingly to achieve best combustion within the engine cylinders. Further, as previously stated, during this time period A–B, the charging efficiency of the engine is too low to obtain a required increase in the output torque effective for acceleration of the engine. In addition, thereafter, the engine suffers from a sudden increase in the output torque immediately when the charging efficiency increases to such a level that the actual intake air quantity assumes a value required for causing an increase in the output torque effective for acceleration of the engine, that is, immediately after the point B in FIG. 1. This sudden torque increase causes rotational displacement of the engine body on its mount about its crankshaft. This displacement of the engine body becomes conspicuous immediately after the point B on the time abscissa as shown in (e) of FIG. 1, and the engine body position becomes stabilized after the point C in FIG. 1 after which the engine rotational speed Ne smoothly increases. Such sudden change in the engine body position taking place between the points B and C brings about an impact upon a vehicle body through the engine mount, in which the engine is installed, and the magnitude of such impact corresponds to the amount of overshooting of the engine body position to the downward side (as viewed in FIG. 1) with respect to the stable engine body position assumed after the point C during engine acceleration, as indicated as the hatched portion in (e) of FIG. 1. The magnitude of the impact can usually surpass the shock aborbing capacity of a shock absorber such as rubber interposed between the engine body and its mount, creating an unpleasant feeling of shock to the driver and the passenger(s).

On the other hand, if the valve opening period value TOUT' is corrected by the use of the correction variable TACC whose value varies as a function of the rate of change $\Delta\theta$ in the throttle valve opening $\theta$th, in a manner shown by the broken line in (b) of FIG. 1, the above time lag can be reduced by a small margin, since this application of correction variable TACC more or less serves to compensate for inaccuracy of the fuel supply quantity caused by the detection lag of the intake pipe absolute pressure. However, since the correction variable TACC is merely a function of the rate of change $\Delta\theta$ of the throttle valve opening alone and is not set by taking into account the displacement of the engine body relative to the lapse of time, the application of the same correction variable to correction of the valve opening period does not substantially contribute to improvement of the engine torque curve characteristic, and to the contrary, it can even cause a further increase in the shock due to displacement of the engine body as indicated by the broken line in (e) of FIG. 1.

Figure 3:
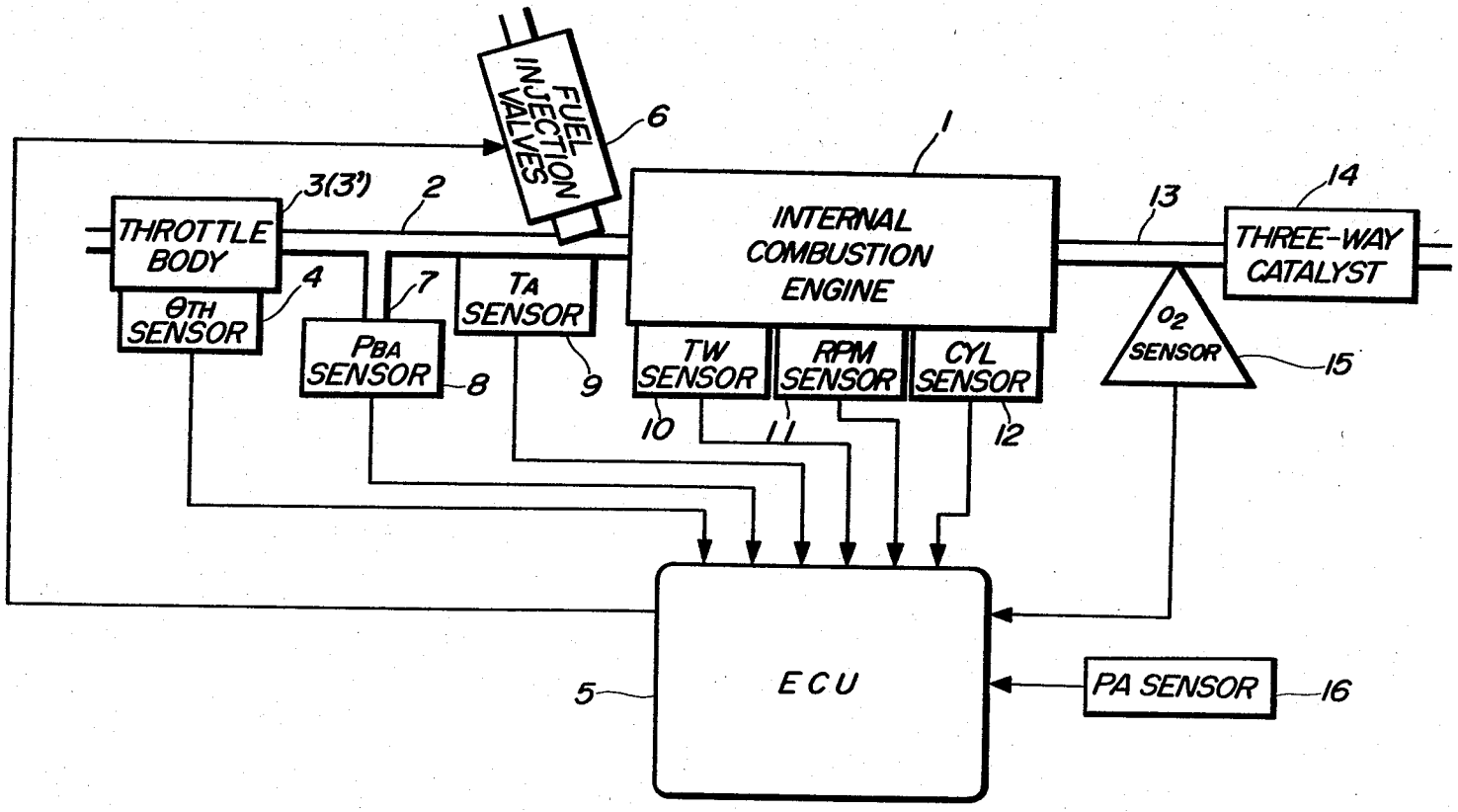
FIG. 3 is a block diagram illustrating, by way of example, the whole arrangement of a fuel supply control system to which is applied the method according to the present invention.

Referring to FIG. 3, there is illustrated the whole arrangement of a fuel supply control system for internal combustion engines, to which the method according to the invention is applied. Reference numeral 1 designates an internal combustion engine which may be a four-cylinder type for instance, and whose body is mounted on a mount of a vehicle body via an elastic shock absorber formed e.g. of rubber, not shown. An intake pipe 2 is connected to the engine 1, in which is arranged a throttle valve 3 to which is connected a throttle valve opening $\theta$th sensor 4 for detecting its valve opening and converting same into an electrical signal which is supplied to an electronic control unit (hereinafter called "the ECU") 5.

Fuel injection valves 6 are arranged in the intake pipe 2 at a location between the engine 1 and the throttle body 3 accommodating a throttle valve 3', which correspond in number to the engine cylinders and are each arranged at a location slightly upstream of an intake valve, not shown, of a corresponding engine cylinder. These injection valves are connected to a fuel pump, not shown, and also electrically connected to the ECU 5 in a manner having their valve opening periods or fuel injection quantities controlled by signals supplied from the ECU 5.

On the other hand, an absolute pressure sensor (PBA sensor) 8 communicates through a conduit 7 with the interior of the intake pipe at a location downstream of the throttle valve 3. The absolute pressure sensor 8 is adapted to detect absolute pressure in the intake pipe 2 and supplies an electrical signal indicative of detected absolute pressure to the ECU 5. An intake air temperature (TA) sensor 9 is arranged in the intake pipe 2 at a location downstream of the absolute pressure sensor 8 and also electrically connected to the ECU 5 for supplying same with an electrical signal indicative of detected intake air temperature.

An engine temperature (TW) sensor 10, which may be formed of a thermistor or the like, is embedded in the cylinder block of the engine 1, an electrical output signal of which is supplied to the ECU 5.

An engine rotational angle position (RPM) sensor 11 and a cylinder-discriminating (CYL) sensor 12 are arranged in facing relation to a camshaft, not shown, of the engine 1 or a crankshaft of same, not shown. The former 11 is adapted to generate one pulse at a particular crank angle of the engine each time the engine crankshaft rotates through 180 degrees, as a top-dead-center position (TDC) signal, while the latter is adapted to generate one pulse at a particular crank angle of a particular engine cylinder. The above pulses generated by the sensors 11, 12 are supplied to the ECU 5.

A three-way catalyst 14 is arranged in an exhaust pipe 13 extending from the cylinder block of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen in the exhaust gases and supplying an electrical signal indicative of the detected concentration value to the ECU 5. Further connected to the ECU 5 are a sensor 16 for detecting atmospheric pressure and supplying an electrical signal indicative of detected atmospheric pressure to the ECU 5.

The ECU 5 operates in response to various engine operation parameter signals as stated above, to determine operating conditions in which the engine is operating, such as a fuel cut effecting condition, an accelerating condition, and a decelerating condition, and to calculate the fuel injection period TOUT of the fuel injection valves 6, which is given by the following equation, in accordance with the determined operating conditions of the engine and in synchronism with generation of pulses of the TDC signal:

$$TOUT = Ti \times K_1 + TACC \times K_2 + K_3 \ldots \quad (1)$$

where Ti represents a basic value of the fuel injection period for the fuel injection valves 6, which has its value determined as a function of the engine rotational speed Ne and the intake pipe absolute pressure PBA, and TACC a correction variable applied when the engine is accelerating, which has its value determined by a subroutine shown in FIG. 5, described hereinafter. $K_1$, $K_2$, and $K_3$ are correction variables which have their values calculated by the use of respective equations on the basis of the values of the engine operation parameter signals from the aforementioned various sensors so as to optimize the operating characteristics of the engine such as startability, emission characteristics, fuel consumption and accelerability.

The ECU 5 operates on the value of the fuel injection period TOUT determined as above to supply corresponding driving signals to the fuel injection valves 6 to drive same.

Figure 4:
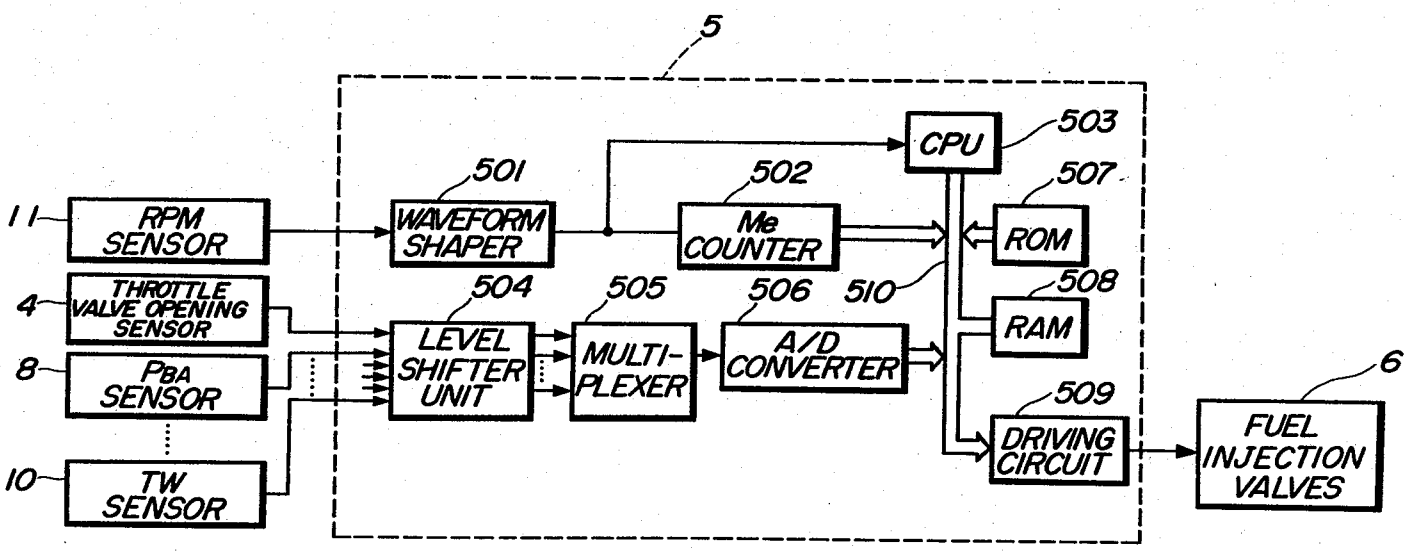
FIG. 4 is a block diagram illustrating, by way of example, the interior construction of an electronic control unit (ECU) appearing in FIG. 3.

FIG. 4 shows a circuit configuration within the ECU 5 in FIG. 3. An output signal from the engine rotational angle position (RPM) sensor 11 is applied to a waveform shaper 501, wherein it has its pulse waveform shaped, and supplied to a central processing unit (hereinafter called "the CPU") 503, as the TDC signal, as well as to an Me value counter 502. The Me value counter 502 counts the interval of time between a preceding pulse of the TDC signal and a present pulse of the same signal, inputted thereto from the engine rotational angle position sensor 11, and therefore its counted value Me varies in proportion to the reciprocal of the actual engine rpm Ne. The Me value counter 502 supplies the counted value Me to the CPU 503 via a data bus 510.

The respective output signals from the throttle valve opening sensor 4, the intake pipe absolute pressure PBA sensor 8, the engine cooling water temperature (TW) sensor 10, etc. appearing in FIG. 3 have their voltage levels successively shifted to a predetermined voltage level by a level shifter unit 504 and applied to an analog-to-digital converter 506 through a multiplexer 505.

Further connected to the CPU 503 via the data bus 510 are a read-only memory (hereinafter called "the ROM") 507, a random access memory (hereinafter called "the RAM") 508 and a driving circuit 509. The RAM 508 temporarily stores various calculated values from the CPU 503, while the ROM 507 stores a control program to be executed within the CPU 503 as well as maps of a basic fuel injection period Ti for the fuel injection valves 6, which have values read as a function of intake pipe absolute pressure and engine rotational speed, and a set of correction variable TACC tables arranged in a plurality of groups, etc. The CPU 503 executes the control program stored in the ROM 507 to calculate the fuel injection period TOUT for the fuel injection valves 6 in response to the various engine operation parameter signals and parameter signals for correction of the fuel injection period, and supplies the calculated value of fuel injection period to the driving circuit 509 through the data bus 510. The driving circuit 509 supplies driving signals corresponding to the above calculated TOUT value to the fuel injection valves 6 to drive same.

Figures 5, 5A:
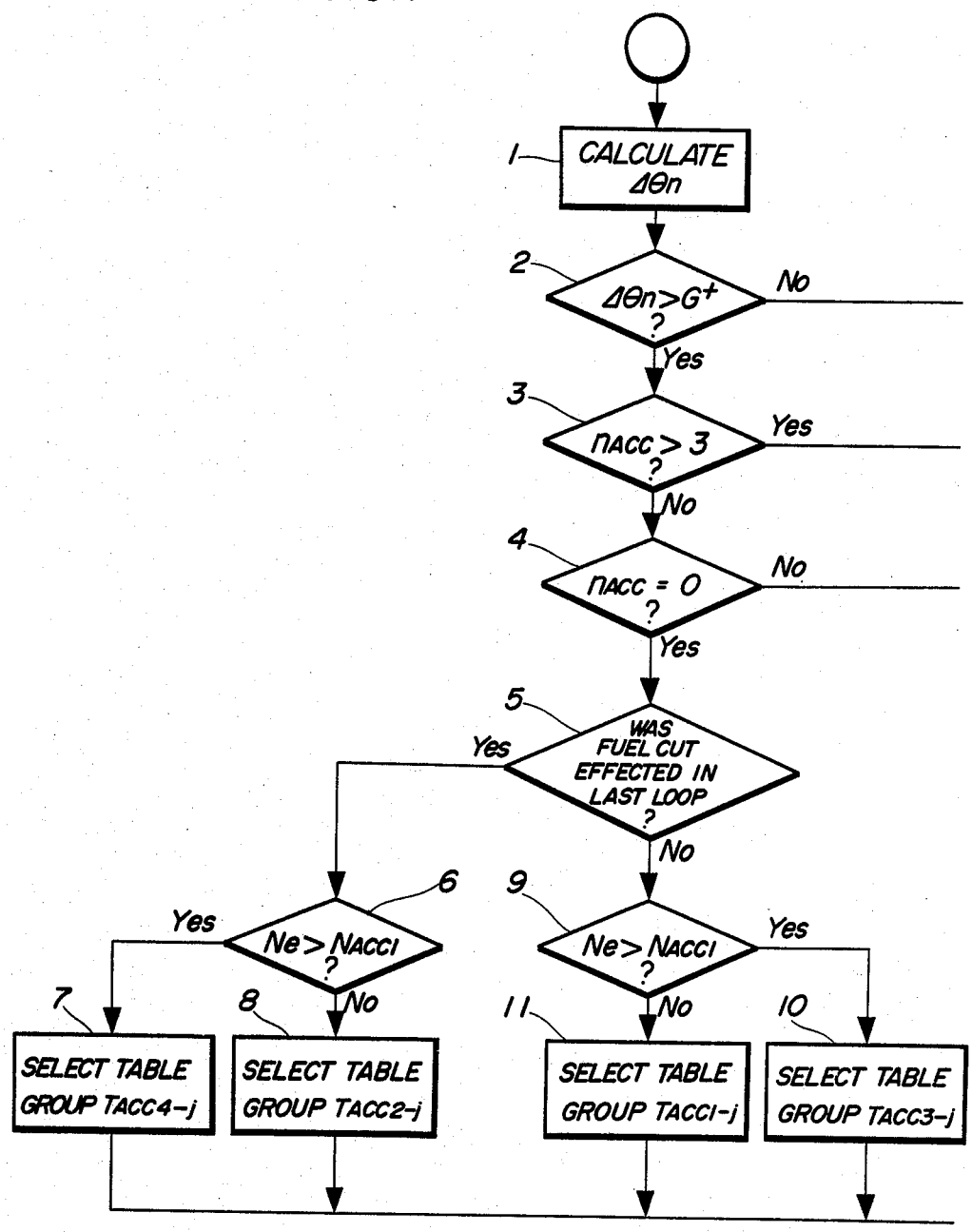
FIGS. 5*a* and 5*b* are a flowchart of a manner of setting the value of the correction variable TACC at acceleration of the engine according to the method of the invention.
Figure 5B:
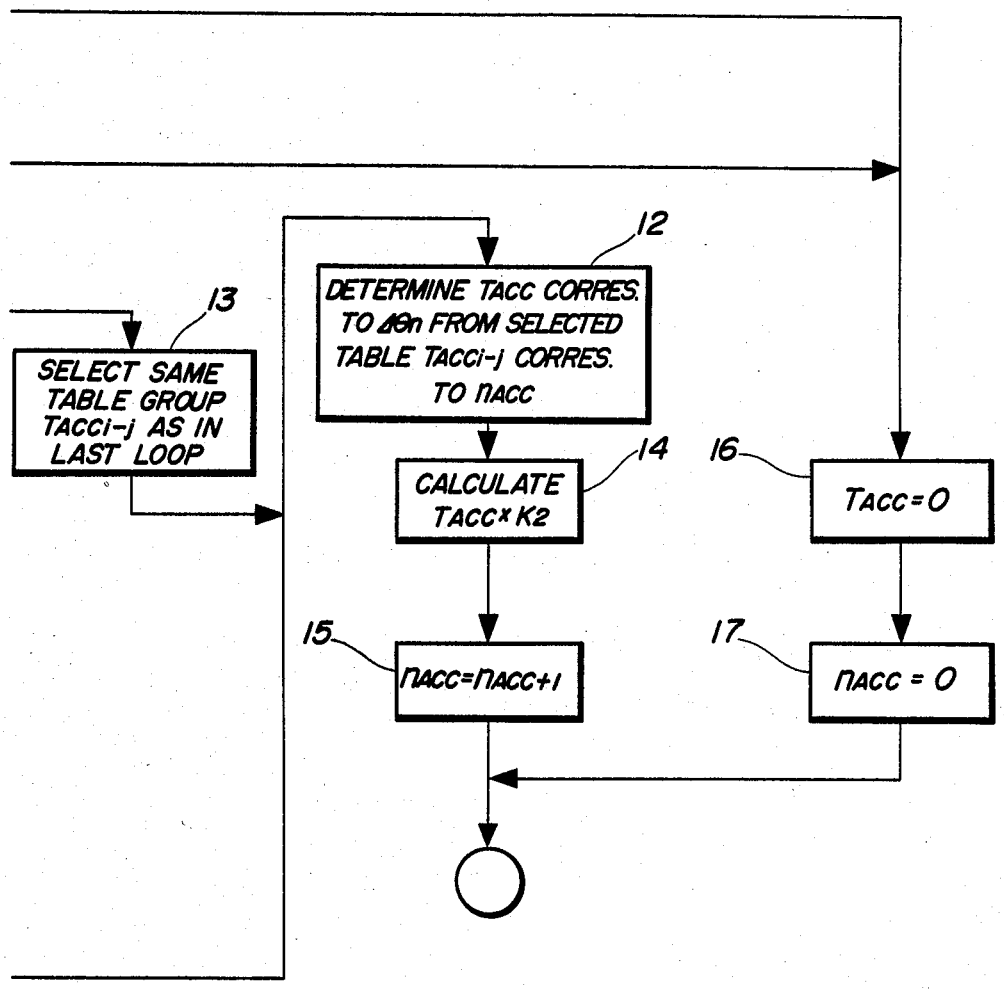

FIG. 5 shows a flow chart of a control program for determining the value of the correction variable TACC, which is executed in synchronism with generation of pulses of the TDC signal.

According to this control program, first a rate of change in the throttle valve opening, i.e. an amount of variation $\Delta\theta n$ in the valve opening $\theta$th of the throttle valve 3 in FIG. 1 is calculated at the step 1. This calculation is made by determining a difference $\Delta\theta n = \theta thn - \theta thn - 1$ between a valve opening value $\theta$thn detected at the time of generation of a present pulse of the TDC signal and a valve opening valve $\theta$thn − 1 detected at the time of generation of a preceding pulse of the same signal. In lieu of the TDC signal, a clock signal having a constant pulse repetition period may be employed as the sampling signal for calculation of the throttle valve opening value $\theta$th in synchronism with generation of pulses thereof.

Then, it is determined at the step 2 whether or not the calculated amount of variation $\Delta\theta n$ is larger than a predetermined value G+ for determining acceleration of the engine (e.g. +0.4 degrees per each pulse of the TDC signal). If the answer is yes, that is, if the relationship $\Delta\theta n > G+$ stands and accordingly the engine is determined to be in an accelerating condition, the step 3 is executed to determine whether or not a control variable NACC has a value larger than 3.

The control variable NACC initially has a value of 0 and then has its value increased by 1 each time a pulse of the TDC signal is generated immediately after the engine has entered the accelerating condition, at the step 15, as hereinafter described. That is, the step 3 is to determine whether or not a period of time corresponding to the time period for generation of four pulses of the TDC signal has elapsed after the engine entered the accelerating region.

If the answer to the question of the step 3 is negative or no, that is, if the value of the control variable NACC is 0, 1, 2 or 3, it is then determined whether or not the value of the control variable NACC is 0, at the step 4.

If the answer to the step 4 is yes, that is, if the engine is operating in the accelerating condition and also the value of the control variable NACC is 0, it can be regarded that a present pulse of the TDC signal is the first pulse after the engine has entered the accelerating region. In such case, a group of TACC tables is selected at the steps 5 through 11, which group is most suitable for the operating condition of the engine in the accelerating region which the engine has just entered immediately before the generation of the present pulse of the TDC signal, depending upon whether or not the engine was operating in a fuel cut effecting condition at the time of generation of the preceding pulse of the TDC signal, as well as upon whether or not the engine rotational speed Ne determined from a value Me counted at the time of generation of the present pulse of the TDC signal is larger than predetermined rpm.

First at the step 5, it is determined whether or not the engine was operating in the fuel cut effecting condition at the time of generation of the preceding pulse of the TDC signal. If the answer is yes, that is, if the fuel cut was effected in the last loop, it is then determined at the step 6 whether or not the engine rotational speed Ne determined at the time of generation of the present pulse of the TDC signal is larger than the predetermined rpm $NACC_1$ (e.g. 1,500 rpm).

If the answer to the step 6 is affirmative, that is, if the fuel cut was effected in the last loop and the relationship $Ne > NACC_1$ stands, the program proceeds to the step 7 where a fourth group of tables $TACC_{4\text{-}j}$ is selected. On the other hand, if the answer to the step 6 is negative, that is, if the fuel cut was effected in the last loop and the relationship $Ne \leqq NACC_1$ stands, a second group of tables $TACC_{2\text{-}j}$ is selected at the step 8.

If the answer to the step 5 is negative, that is, if the fuel cut was not effected in the last loop, the program proceeds to the step 9 where it is determined whether or not the engine rotational speed Ne is larger than the predetermined rpm $NACC_1$, in the same manner as in the step 6.

If it is determined at the step 9 that the fuel cut was not effected in the last loop and the relationship $Ne > NACC_1$ stands, a third group of tables $TACC_{3\text{-}j}$ is selected at the step 10. If it is determined at the step 9 that the fuel cut was not effected in the last loop and the relationship $Ne \leqq NACC_1$ stands, a first group of tables $TACC_{1\text{-}j}$ is selected at the step 11.

The following is the reason why different groups of TACC tables are selected depending upon the results of determination at the step 5, that is, depending upon whether the engine operating condition shifts into the accelerating region directly from the fuel cut effecting region, or it shifts into the accelerating region from the fuel-supplying operating region:

If the engine is operating with the supply of fuel cut off, the inner wall of the intake pipe becomes dried due to evaporation of fuel deposited thereon. Therefore, unless at the beginning of resumption of the supply of fuel upon termination of the fuel cut effecting condition, the fuel quantity is increased to such an extent that the inner wall of the intake pipe has its surfaces saturated with fuel, a mixture supplied to combustion chambers of the engine has too lean an air/fuel ratio. Further, if the engine is operating with the fuel supply thereto cut off, there will be left no residual $CO_2$ in the cylinders of the engine, also causing leaning of the air/fuel ratio. Therefore, if the engine was in a fuel cut condition just before it enters the accelerating region, a larger quantity of fuel should be supplied to the engine than that if it was not in such a fuel cut condition. In order to meet with this requirement, several groups of TACC tables are provided according to the present invention.

The reason for selecting different groups of TACC tables depending upon the results of determination of the step 6 or the step 9 is that the fuel quantity required by the engine varies depending upon the operating condition of the engine at acceleration.

Figure 6:
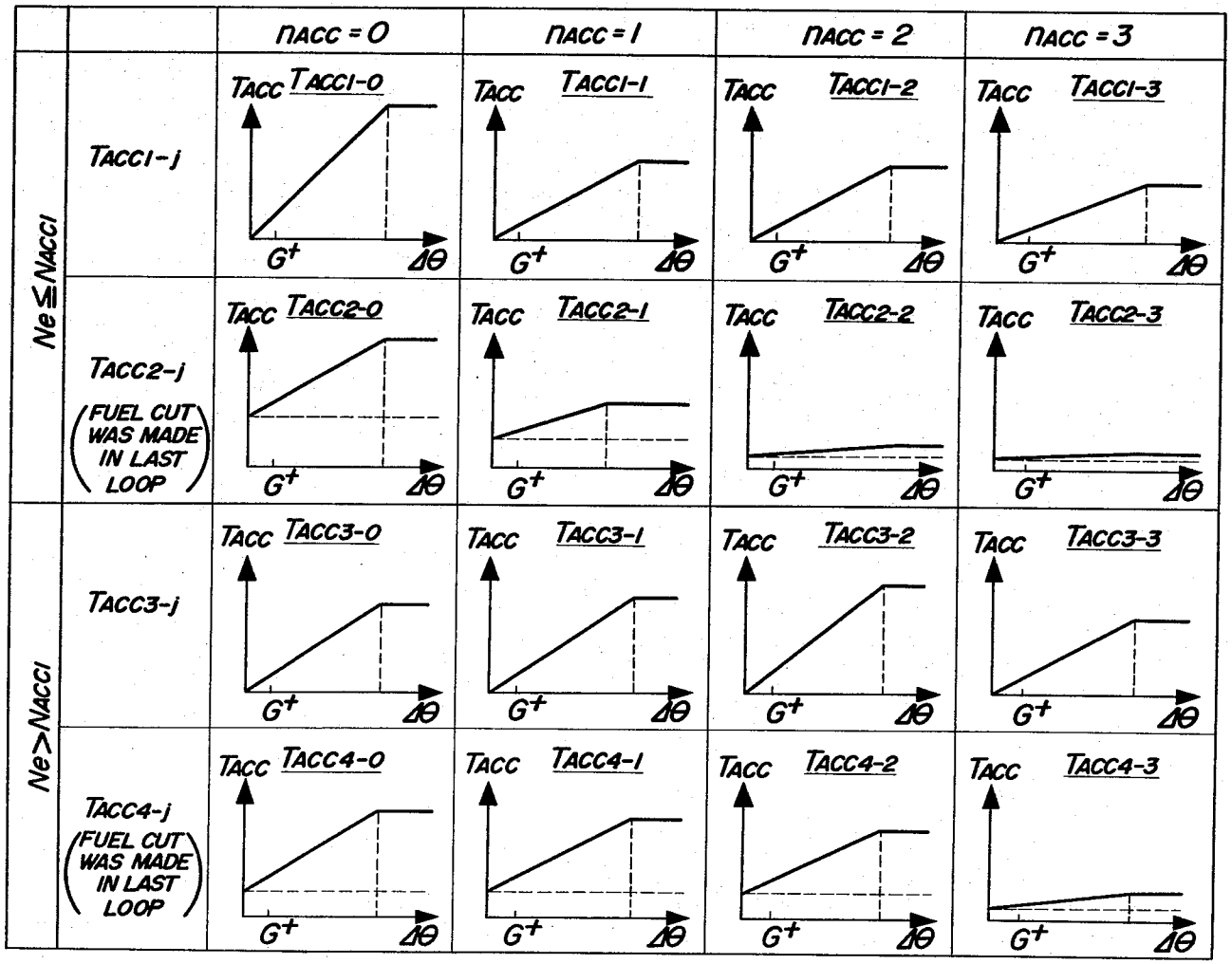
FIG. 6 is a graph showing a plurality of groups of tables for determining values of the correction variable TACC according to the method of the invention.

The first to fourth groups of tables $TACC_{1\text{-}j}$–$TACC_{4\text{-}j}$ each comprise a plurality of different tables which are selected according to the value of the control variable NACC variable with generation of pulses of the TDC signal. More specifically, in the table group $TACC_{i\text{-}j}$ (i=1, 2, 3, or 4), tables $TACC_{i\text{-}0}$, $TACC_{i\text{-}1}$, $TACC_{i\text{-}2}$, and $TACC_{i\text{-}3}$ are selected, respectively, when the control variable NACC assumes values of 0, 1, 2 and 3. In each of these tables $TACC_{i\text{-}j}$ (j=0, 1, 2, or 3), correction values TACC are set in relation to amounts of variation of the throttle valve opening. As may be seen from FIG. 6, in the groups $TACC_{1\text{-}j}$ and $TACC_{2\text{-}j}$, which are selected when the detected rotational speed is less than or equal to the predetermined value NACCl, if the variation $\Delta\theta$ of the throttle valve opening remains the same, the correction values TACC decrease on successive pulses of the TDC signal.

Reverting now to FIG. 5, after any one of the table groups $TACC_{i\text{-}j}$ has been selected at the step 7, 8, 10 or 11, the program proceeds to the step 12 where a table $TACC_{i\text{-}j}$ is selected out of the selected table group, which corresponds to the value of the control variable NACC then assumed, and read from this selected table $TACC_{i\text{-}j}$ is a TACC value corresponding to the actual amount of variation $\Delta\theta n$ of the throttle valve opening $\theta th$ of the throttle valve 3 calculated at the step 1.

If the answer to the question of the step 4 is negative, that is, if the control variable NACC assumes a value of 1, 2 or 3, the program proceeds to the step 13 wherein the same table group $TACC_{i\text{-}j}$ as one selected at the time of generation of the preceding pulse of the TDC signal is selected, followed by execution of the above step 12. That is, at the time of generation of a first pulse of the TDC signal immediately after the engine has entered the accelerating region wherein NACC is 0, a table group $TACC_{i\text{-}j}$ corresponding to the operating condition in which the engine is then operating is selected at the step 7, 8, 10 or 11, and then a TACC value is determined from the first group $TACC_{i\text{-}0}$ of the selected table group at the step 12. Thereafter, each time a subsequent pulse of the TDC signal is generated, a TACC value is read from another second, third or fourth table of the same selected table group, which corresponds to a value of the control variable NACC then assumed, in a successive manner.

After a TACC value has been determined at the step 12, the step 14 is executed wherein a calculation is made of the term $(TACC \times K_2)$ in the aforementioned equation (1). Then, a value of 1 is added to the value of the control variable NACC at the step 15, thus terminating the execution of the present loop of the control program.

If the answer to the question of the step 3 is affirmative, that is, if four pulses of the TDC signal have been generated after the engine has entered the accelerating region, it is regarded that the fuel quantity-correction period at acceleration of the engine has elapsed, whereas if the answer to the question of the step 2 is negative, that is, if the relationship $\Delta\theta n \leqq G+$ stands, it is regarded that the engine is operating in a region other than the accelerating region. In either case, the value of the fuel correction variable TACC is set to 0 at the step 16, while at the same time the value of the control variable NACC is reset to 0 at the step 17, terminating the execution of the present loop of the control program.

A value of the term ($TACC \times K_2$) calculated at the step 14 or at the step 16 is applied to the aforementioned equation (1), by the use of which is made a calculation of the valve opening period TOUT of the fuel injection valves 6 in accordance with another control program. A quantity of fuel corresponding to the calculated TOUT value is supplied to the engine.

Figure 7:
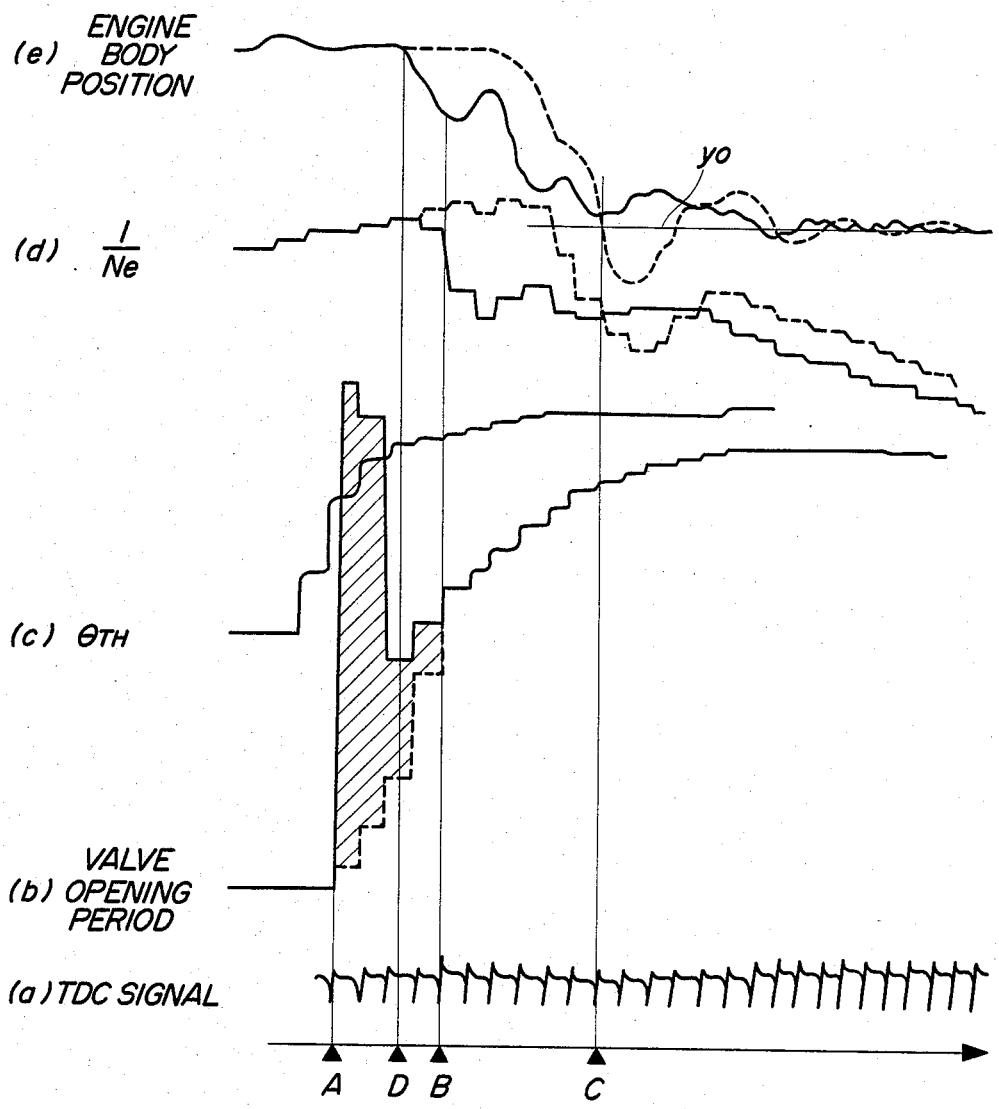
FIG. 7 is a timing chart showing changes in the engine rotational speed Ne and displacement of the engine body on its mount with the lapse of time at acceleration of the engine according to the method of the invention.

In the above described manner, according to the present embodiment, when the valve opening of the throttle valve increases to bring the engine into the accelerating region as shown in (c) of FIG. 7, the valve opening period value TOUT of the fuel injection valves is corrected by the TACC value as shown in (b) of FIG. 7 at the beginning of the accelerating operation. As previously stated, values of the term TACC each corresponding to the actual value of the amount of variation $\Delta\theta n$ of the throttle valve opening $\theta th$ are each read from a different TACC table each time a pulse of the TDC signal is generated as shown in (a) of FIG. 7. That is, the TACC value is determined as a function of the variation amount $\Delta\theta n$ and the progress of time.

By virtue of this manner of control, promptly after initiation of an accelerating operation, it is possible to obtain an increase in the engine torque and accordingly enable starting an increase in the engine rotational speed Ne, i.e. a decrease in the value of 1/Ne shown in (d) of FIG. 7 before the lapse of a short period of time corresponding to the time period required for generation of four pulses of the TDC signal between the points A and B on the time abscissa in FIG. 7.

Further, since the value of the fuel increasing correction variable TACC is determined as a function of the progress of time, it is possible to control the amount of torque and the timing of increasing the torque by means of increases in the charging efficiency of the engine and the fuel supply quantity. Moreover, according to the invention, the accelerating fuel incremental value is set to values two to four times as large as a normal basic value ($Ti \times K1$) which is conventionally applied, at the time of initiation of acceleration just after the throttle valve has been opened when the charging efficiency is still small (five to ten times as large as the normal value immediately after termination of a fuel cut operation). This enables to attain an initial torque increasing period (the time period between the points D and B in (e) of FIG. 7) soon after detection of acceleration of the engine (the point A in FIG. 7). Further, the initial torque increase can be kept small due to the small charging efficiency at the time of initiation of acceleration of the engine, thereby minimizing the backlash of gears of the driving system without causing a shock, and at an early time shortly after detection of acceleration of the engine (the point B in FIG. 7) the engine body position can be brought to an intermediate position (in the vicinity of the point B in (e) of FIG. 7) in the course of its moving toward the stable position on the accelerating side (the level $y_o$ in (e) of FIG. 7). Such an amount of fuel is supplied to the engine as can maintain the mounting position of the engine body at the above intermediate position until the actual charging efficiency increases to obtain effective engine torque required for obtaining acceleration of the engine. As a result, rotational displacement of the engine body on its mount about the crankshaft can take place along a gentle curve as shown in (e) of FIG. 7, thereby reducing shock upon the driver which is caused by rotational displacement of the engine body on its mount about its crankshaft, as well as by backlash of the gears, etc. at acceleration of the engine.

According to the conventional example shown in (e) of FIG. 7, as indicated by the broken line therein, the engine body once collides with its mount at the point C, is then moved away from the mount by the colliding reaction force, and again moved back to its stable position (the level $y_o$ in (e) of FIG. 7), which delays the transmission of accelerating torque to the driving system. According to the present invention, as indicated by the solid line in (e) of FIG. 7, the engine body is already displaced to an intermediate position in the course of its displacement to its stable position upon acceleration of the engine and stably maintained thereat before the generation of effective torque, thereby obtaining accelerating torque at the same time of increase of the effective torque, resulting in improved accelerability of the engine.

Large accelerating shock takes place only upon acceleration of the engine from a fuel cut condition or from a low load condition (at engine speeds below 3000 rpm), but it will not take place under other accelerating conditions such as acceleration from a cruising condition at an engine speed above 3000 rpm, whereby there occurs no large displacement of the engine body due to friction of the driving system. Therefore, a group of TACC tables simulating a conventional accelerating fuel increasing characteristic (e.g. the table group $TACC_{3\text{-}j}$ in FIG. 6) may also be provided in case for such accelerating conditions.

Although in the above described embodiment it is determined from the amount of variation $\Delta\theta n$ of the throttle valve opening whether or not the engine has entered the accelerating region, the invention is not limited to this determining manner, but any other manner may be employed for determination of the accelerating condition of the engine, such as means for sensing the position of the accelerator pedal of the engine.

What is claimed is:

1. A control method of supplying an internal combustion engine with required quantities of fuel appropriate to operating conditions of said engine, in synchronism with pulses of a control signal generated at predetermined crank angle positions of said engine, said method comprising the steps of:

(1) determining whether or not said engine is operating in a predetermined accelerating condition;

(2) detecting a value of a predetermined operating parameter of said engine indicative of the engine load, in synchronism with a predetermined sampling signal;

(3) determining a rate of change in th value of said predetermined operating parameter from values of the same detected in said step (2);

(4) when it is determined in said step (1) that said engine is operating in said predetermined accelerating condition, setting the value of a correction variable for increasing the fuel quantity to be supplied to said engine in said predetermined accelerating condition, to a value corresponding to the number of pulses of said control signal generated from the time said determination that said engine is operating in said predetermined accelerating condition is obtained for the first time, and also corresponding to the rate of change in the value of said predetermined operating parameter detected in said step (3), each time a pulse of said control signal is generated;

(5) applying the set value of said accelerating correction variable to setting of a quantity of fuel to be supplied to said engine in said predetermined accelerating condition; and (6) supplying the set quantity of fuel to said engine in said predetermined accelerating condition.

2. A control method as claimed in claim 1, wherein a plurality of tables are stored beforehand, each of which is formed of a plurality of values of said accelerating correction variable corresponding, respectively, to different values of the rate of change in the value of said predetermined operating parameter, and wherein said step (4) comprises selecting a different one of said tables which corresponds to the number of pulses of said control signal generated from the time said determination that said engine is operating in said predetermined accelerating condition is obtained for the first time, and reading from said selected table a value of said accelerating correction variable which corresponds to a value of the rate of change in the value of said predetermined operating parameter detected in said step (3).

3. A control method as claimed in claim 2, wherein said plurality of tables are divided into a plurality of groups which are to be selected in response to at least one second operating parameter of said engine other than said first-mentioned predetermined operating parameter, and wherein said step (4) comprises detecting a value of said at least one second operating parameter when said determination that said engine is operating in said predetermined accelerating condition is obtained for the first time, selecting one of said plurality of groups of tables which corresponds to the detected value of said at least one second operating parameter, and reading a value of said correction variable from said selected one group of tables, which corresponds to the number of pulses of said control signal generated from the time said determination that said engine is operating in said predetermined accelerating condition is obtained for the first time, and also corresponds to a value of the rate of change in the value of said predetermined operating parameter detected in said step (3).

4. A control method as claimed in any one of claims 1, 2 and 3, wherein said engine is provided with an intake passage and a throttle valve arranged in said intake passage, said first-mentioned predetermined operating parameter being the valve opening of said throttle valve.

5. A control method as claimed in claim 4, wherein said setting of a fuel quantity of said step (5) based upon said correction variable is effected only when the rate of change of the valve opening of said throttle valve detected in said step (3) is larger than a predetermined value.

6. A control method as claimed in claim 3, wherein said other at least one second operating parameter of said engine comprises the rotational speed of said engine.

7. A control method as claimed in claim 6, wherein said plurality of groups of tables include at least one group which is to be selected when a detected value of the rotational speed of said engine is lower than a predetermined value, said at least one group having values of said correction variable thereof set such that they assume smaller values with an increase in the number of pulses of said control signal generated from the time said determination that said engine is operating in said accelerating condition is obtained for the first time, so long as the value of the rate of change in the value of said first-mentioned predetermined operating parameter remains constant.

8. A control method as claimed in claim 7, wherein the increase in the fuel quantity to be supplied to said engine in said predetermined accelerating condition is set to smaller values in said step (5) as the value of said correction variable determined in said step (4) assumes smaller values.

9. A control method as claimed in claim 3, wherein said at least one second operating parameter of said engine comprises a parameter indicative of whether or not a first pulse of said control signal has been generated after interruption of the fuel supply to said engine which is effected while the engine is decelerating in a predetermined condition.

10. A control method as claimed in claim 1, wherein in said step (4) the value of said correction variable is set to different values corresponding, respectively, to different values of the number of said pulses of said control signal.

* * * * *